United States Patent [19]

Asai et al.

[11] Patent Number: 4,599,887

[45] Date of Patent: Jul. 15, 1986

[54] APPARATUS FOR CONTROLLING DYNAMIC CHARACTERISTICS OF PRESS LOAD

[75] Inventors: Akio Asai; Yukito Ando; Kazunari Kirii, all of Toyota, Japan

[73] Assignee: Toyota Jidosha Kabushiki Kaisha, Toyota, Japan

[21] Appl. No.: 758,125

[22] Filed: Jul. 23, 1985

[51] Int. Cl.[4] ..... B21J 9/18

[52] U.S. Cl. ..... 72/453.13; 72/21; 267/119

[58] Field of Search ..... 72/20, 21, 453.13, 353, 72/354; 267/119

[56] References Cited

U.S. PATENT DOCUMENTS

| | | | |
|---|---|---|---|
| 2,920,675 | 1/1960 | Hatch | 267/119 |
| 3,653,301 | 4/1972 | Clendenin et al. | 267/119 |
| 3,914,978 | 10/1975 | Sekanina et al. | 267/119 |
| 3,962,895 | 6/1976 | Rydell | 267/119 |
| 4,056,965 | 11/1977 | Heiser | 267/119 |
| 4,210,165 | 7/1980 | Kitsugi | 267/119 |

*Primary Examiner*—John Sipos
*Assistant Examiner*—Donald R. Studebaker
*Attorney, Agent, or Firm*—Cushman, Darby & Cushman

[57] ABSTRACT

An apparatus, for controlling dynamic characteristics of a press load, facilitates changing the balance between a hydraulic pressure and a pneumatic pressure in a hydroblank holder, wherein a first pneumatic device which supplies a standard pneumatic pressure with which a predetermined dynamic load can be obtained and a second pneumatic device which supplies a pneumatic pressure higher or lower than the standard pneumatic pressure are provided in parallel in a pneumatic device which supplies pneumatic pressure to the hydroblank holder and the first and second pneumatic devices are switched in accordance with a press stroke and, when the switching is made to low pressure, an accumulator is depressurized by the operation of a depressurizing device.

6 Claims, 5 Drawing Figures

APPARATUS FOR CONTROLLING DYNAMIC CHARACTERISTICS OF PRESS LOAD

FIELD OF THE INVENTION

This invention relates to an apparatus for controlling press load in a mechanical double-action press machine, and more particularly to a control apparatus by which dynamic characteristics of outer load can be changed as desired.

BACKGROUND OF THE INVENTION

A mechanical double-action press machine is normally provided with a regulating mechanism which regulates press load. This regulating mechanism, as shown in FIG. 1, comprises hydroblank holder 4, protective cylinder 8, a pneumatic device 12 and hydraulic device 15.

The hydroblank holder 4 incorporates piston 1 and has air chamber 2 and oil chamber 3 defined by the piston 1. The protective cylinder 8 defines oil chamber 7 at connection part between connection screw 5 and outer slide 6. The pneumatic device 12 includes pneumatic source 9, pressure regulating valve 10 and accumulator 11 and supplies a predetermined pneumatic pressure to oil chamber 2 in hydroblank holder 4. The hydraulic device 15 includes hydraulic source 13 and check valve 14 and supplies a hydraulic pressure to oil chamber 3 in hydroblank holder 4 and oil chamber 7 in protective cylinder 8.

When pneumatic pressure supplied to air chamber 2 in hydroblank holder 4, i.e., regulator pressure, is set to a high level in the mechanical double-action press machine equipped with such regulating mechanism, the hydraulic pressure does not operate and the incremental load produced by the pressure application of the press machine is transmitted directly to a press die through outer slide 6 to effect a mechanical zone forming operation. Here, the outer load is determined primarily by the die height.

On the other hand, if the regulator pressure supplied to air chamber 2 is adequately balanced against the hydraulic pressure, the above mentioned incremental load is absorbed by the operation of piston 1 of hydroblank holder 4. Therefore, the load is transmitted to the press die through hydraulic pressure to effect the hydraulic zone forming operation. Here, the outer load is determined by the die height and the regulator pressure.

The values of the die height or the regulator pressure are determined through the procedure of finding the optimal processing condition beforehand by a trial pressing. The values determined in the above procedure are set in the press machine in an actual production line and the press machine executes pressing in accordance with the set conditions.

However, there exist unavoidable mechanical differences between the two press machines. The regulatory pressure is set manually by an operator monitoring meters; hence, it is difficult to effect uniform regulation in practice.

Consequently, press-forming defects, such as surface distortion and cracking are produced by unstable dynamic characteristics of the outer load, varying from the ideal condition. Therefore, in the prior art, a time-consuming process of fitting and adjusting the press die has been necessary.

SUMMARY OF INVENTION

It is an object of the present invention to provide an apparatus for controlling dynamic characteristics of the press load which prevents the occurrence of press-forming defects such as surface distortion and cracking and therefore makes fitting and adjusting of the press die unnecessary.

To this end, the present invention provides an apparatus, for controlling dynamic characteristics of the press load, which comprises:

first pneumatic pressure supply means which is composed of a hydraulic pressure device supplying hydraulic pressure to respective oil chambers in a protector cylinder and a hydroblank holder and a pneumatic device which supplies pneumatic pressure balanced with the above hydraulic pressure and which sets the standard pneumatic pressure in an accumulator so as to obtain predetermined dynamic load characteristics;

second pneumatic pressure supply means which sets pneumatic pressure higher or lower than the above standard pneumatic pressure in an accumulator and which is provided in parallel with the first pneumatic pressure supply means;

depressurizing means which depressurizes the accumulator to the pneumatic pressure set by the first and second pneumatic pressure supply means; and control means which makes the first and second pneumatic pressure supply means and depressurizing means operate with a predetermined timing in accordance with a press stroke.

Each one of the first and second pneumatic pressure supply means is constituted by a passage which is provided with a regulating valve and a solenoid control valve, one of its sides being connected to a pneumatic source and the other side being connected to an accumulator through, for instance, a shuttle valve and pressure control valve.

The depressuring means is constituted by a passage which is provided with a solenoid control valve, a directional control valve, which operates by the excitation of the solenoid control valve, and a relief valve and one side of the passage is connected to the pneumatic source and the other side is connected to the accumulator.

The control means is constituted by switches corresponding to the above three respective solenoid control valves and a switching device; which selectively makes the switches operate with a predetermined timing in accordance with a signal corresponding to the press stroke.

When the control means effects ON-OFF control of the above three solenoid control valves, the pneumatic pressure set by each regulating valve is supplied to the accumulator and the balance between the pneumatic pressure and the hydraulic pressure in the hydroblank holder is changed following the pneumatic pressure so that the dynamic characteristics of the load are changed. In other words, press-forming defects such as surface distortion and cracking can be prevented by the change of the dynamic characteristics and as a result, fitting and adjusting the press die becomes unnecessary.

DETAILED DESCRIPTION OF THE INVENTION

One embodiment of the present invention will be described hereinunder with reference to the accompanying drawings.

Figure 1:
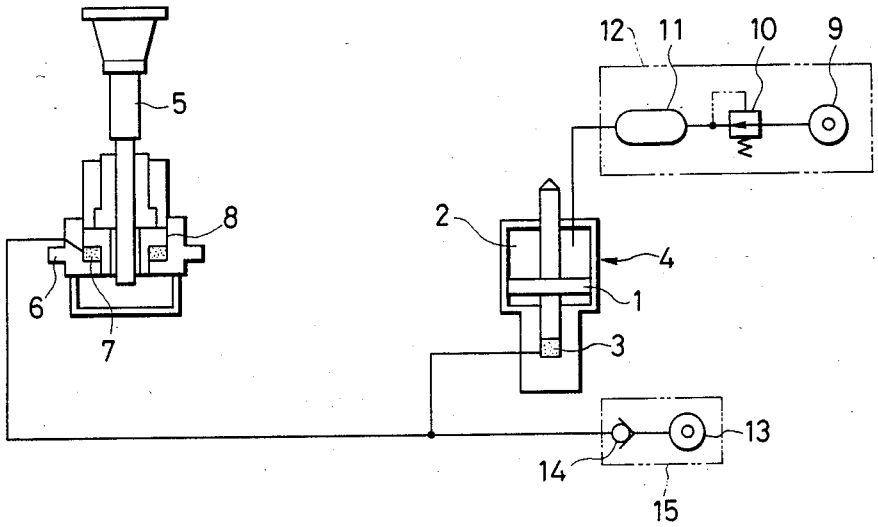
FIG. 1 is a hydraulic and pneumatic circuit diagram of a conventional press machine.
Figure 2:
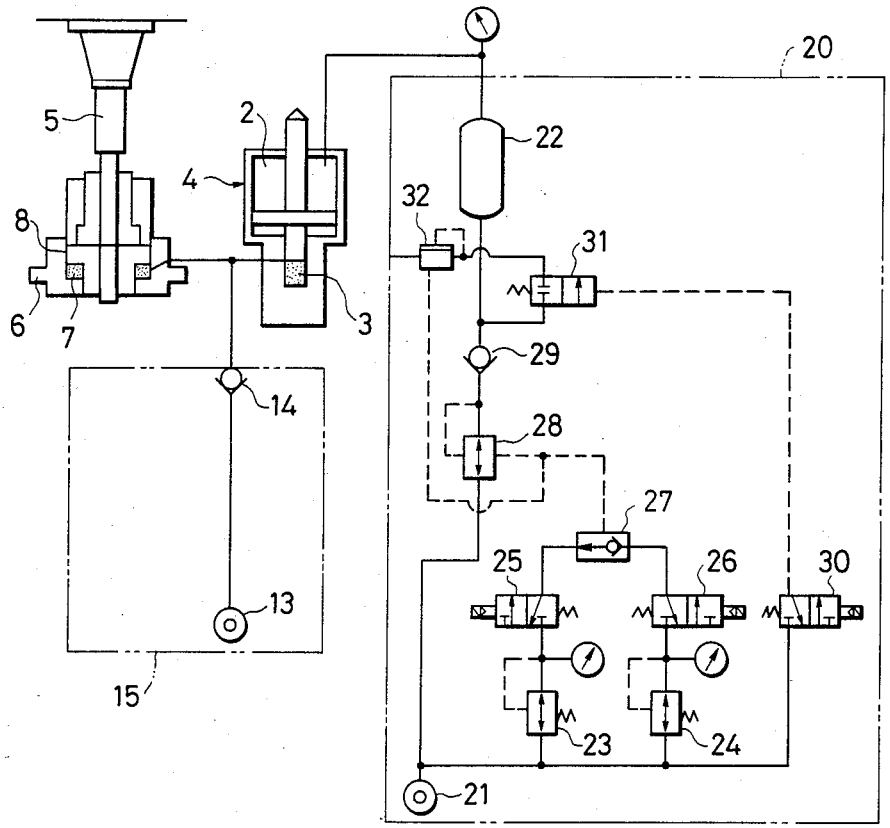
FIG. 2 is a hydraulic and pneumatic circuit diagram of an apparatus for controlling dynamic characteristics of a press load of the present invention.

FIG. 2 shows one embodiment of an apparatus for controlling dynamic characteristics of the press load according to the present invention. It is noted that the same reference numerals are given to the constituent elements which are identical to those shown in FIG. 1 and description of their functions has been omitted. In FIG. 2, the reference numeral 20 denotes a pneumatic device which comprises the present invention. A first regulating valve 23 and a second regulating valve 24 are provided in a parallel circuit connecting pneumatic source 21 and accumulator 22 in pneumatic device 20. The first regulating valve 23 constitutes the first pneumatic pressure supply means with the first solenoid control valve 25 provided on its secondary side and this first pneumatic pressure supply means supplies a standard pneumatic pressure, with which the predetermined dynamic load characteristics can be obtained, to accumulator 22, and basically has a function equivalent to the conventional pneumatic device (shown by the numeral 12 in FIG. 1). The second regulating valve 24 constitutes the second pneumatic pressure supply means with second solenoid control valve 26 provided on its secondary side and this second pneumatic pressure supply means supplies a pneumatic pressure higher or lower than the standard pneumatic pressure to accumulator 22.

These first and second pneumatic pressure supply means are connected by a shuttle valve 27 and are also connected to accumulator 22 through a pressure control valve 28 and a check valve 29. The predetermined pneumatic pressure is supplied to accumulator 22 from either one of the first pneumatic pressure supply means and the second pneumatic pressure supply means by a suitable ON-OFF control of the first and second solenoid control valves 25 and 26.

The third solenoid control valve 30, which is a depressurizing means for accumulator 22, a directional control valve 31 and a relief valve 32 are provided in a circuit connecting pneumatic source 21 and accumulator 22 and these valves operate to depressurize accumulator 22 to the pneumatic pressure set by first or second regulating valve 23 or 24.

Figure 3:
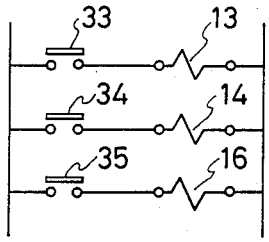
FIG. 3 is a circuit diagram of the switches constituting the control means.

Moreover, as shown in FIG. 3, first, second and third solenoid control valves 25, 26 and 30 are connected to first, second and third switches 33, 34 and 35 respectively. These switches 33, 34 and 35 constitute a control means which performs an ON-OFF control of solenoid control valves 25, 26 and 30 with a switching device (not shown) and operate in accordance with a press stroke signal from a press machine slide.

The practical operation of the apparatus for controlling dynamic characteristics of press load of the above embodiment will now be explained.

Figure 4:
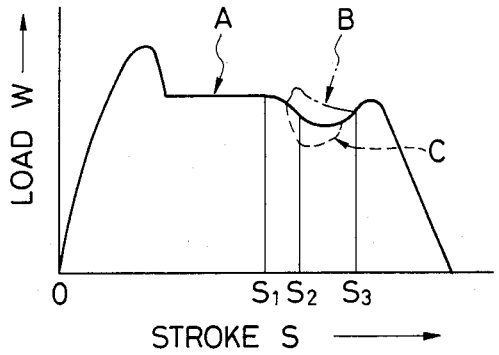
FIG. 4 is a graph showing the dynamic characteristics of the press load.
Figure 5:
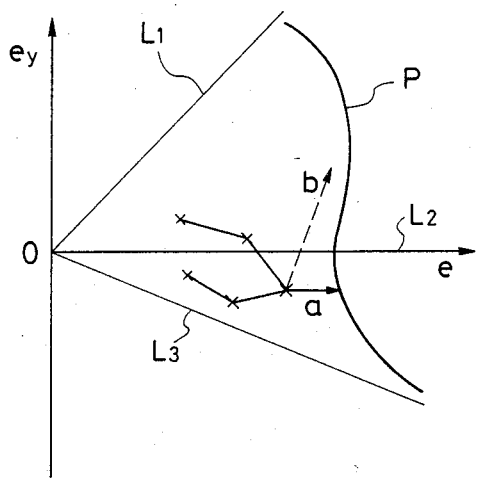
FIG. 5 shows a deformation diagram of a workpiece.

FIG. 4 shows the dynamic characteristics of the press load during the reduction forming process. In FIG. 4, the curve A shows the dynamic characteristics based upon the pneumatic pressure set by first regulating valve 23. Now it is assumed that, when pressing is performed under the above dynamic characteristics, the deformation state at the last stage of the forming is as shown in FIG. 5. In FIG. 5, the symbol $e_x$ represents deformation along the major axis of a scribed circle, $e_y$, deformation along the minor axis of the scribed circle, $L_1$, equi-biaxial tensile characteristics, $L_2$, surface distortion characteristics, $L_3$, uni-axial tensile characteristics and p, a limiting line of deformation. As will be clear from FIG. 5, the forming of the work is progressed toward the limiting line p of deformation as shown by an arrow a and if forming is effected in this manner, the workpiece is likely to be deformed.

However, if the dynamic characteristics of the press load can be changed as shown by the curve B in FIG. 4, the forming of the work will be effected in the direction away from the limiting line p of the forming as shown by an arrow b in FIG. 5 as far as possible. Deformation is thus prevented by the above method.

Consequently, in order to obtain dynamic characteristics as in curve B, in the apparatus for controlling dynamic characteristics of this embodiment, the pneumatic pressure of second regulating valve 24 is set in advance so as to be higher than the pneumatic pressure of first regulating valve 23, i.e., higher than the standard pneumatic pressure. At first, when the press stroke shown in FIG. 4 is between 0 and $S_1$, first switch 33 is ON and second and third switches 34 and 35 are OFF. In other words, first solenoid control valve 25 is ON and second and third solenoid control, valves 26 and 30 are OFF; and accumulator 22 is maintained at standard pneumatic pressure. Then, at the same time that the press stroke reaches $S_1$, second switch 34 is turned ON to actuate shuttle valve 27 to a higher pressure and the pneumatic pressure set by the second regulating valve 24 as mentioned above is supplied to accumulator 22. With this process, the dynamic characteristics of the press load are displaced to the curve B in FIG. 4. When the dynamic characteristics of the press load are displaced like this, material flow into a die is accelerated and the forming of the work is effected in the direction b in FIG. 5 and deformation is avoided as stated above.

When the press stroke reaches $S_2$ which is in the region outside the danger region of breaking, second switch 34 is turned OFF and third switch 35 is turned ON. With this process, third solenoid control valve 30 is turned ON and the directional control valve 31 is opened and the pressurized air in accumulator 22 is depressurized. When the press stroke reaches $S_3$, third switch 35 is turned OFF and with this process the dynamic characteristics of the press load are restored to the original state (curve A).

In the dynamic characteristics of the press load shown in FIG. 4, deformation can also be avoided by displacing the dynamic characteristics to, for instance, the curve C. In this case, the pneumatic pressure of second regulating valve 24 is set in advance to be lower than the standard pneumatic pressure. At the same time when the press stroke reaches $S_1$, first switch 33 is turned OFF and second and third switches 34 and 35 are turned ON and first solenoid control valve 25 is turned OFF and second and third solenoid control valves 26 and 30 are turned ON. With this process, the pneumatic pressure in accumulator 22 is depressurized to the pneumatic pressure set by second regulator 24 and forming is effected in the direction in which deformation of the workpiece is avoided. When the press stroke reaches the stroke $S_2$, first switch 33 is turned ON and second and third switches are turned OFF and the pneumatic pressure set by first regulating valve 23 (the standard pneumatic pressure) is again supplied to accumulator 22 so that the dynamic characteristics of the press load are restored to the original state (curve A).

In the above description, only two examples of the operation are described. However, change in the dynamic characteristics of the load can be freely controlled by regulating the timing of switches 33, 34 and 35 and the timing of switches 33, 34 and 35 are determined adequately in accordance with the state of deformation of the work.

What we claim is:

1. An apparatus, for controlling dynamic characteristics of a press load, comprising:

a hydraulic device means which supplies hydraulic pressure to oil chambers in a protector cylinder and a hydroblank holder; and a pneumatic device means which includes a pneumatic source and an accumulator and supplies a pneumatic pressure balancing said hydraulic pressure to said hydroblank holder, said pneumatic device mean including:

(a) first and second pneumatic pressure supply means provided in parallel, and said first pneumatic pressure supply means being adapted to set a standard pneumatic pressure with which predetermined dynamic load characteristics can be obtained in said accumulator, said second pneumatic pressure supply means being adapted to set a pneumatic pressure higher or lower than said standard pneumatic pressure in said accumulator;

(b) depressurizing means being adapted to depressurize said accumulator to the pneumatic pressure set by said first and second pneumatic pressure supply means; and (c) control means, being adapted to actuate said two pneumatic pressure supply means and said depressurizing means in accordance with a predetermined press stroke at a predetermined timing.

2. An apparatus as claimed in claim 1, wherein each of said two pneumatic pressure supply means comprises a circuit which is provided with a regulating valve and a solenoid control valve.

3. An apparatus as claimed in claim 2, wherein one side of said circuit is connected to the pneumatic source and the other side of said circuit is connected to the accumulator through a shuttle valve.

4. An apparatus as claimed in claim 1, wherein said depressurizing means comprises a circuit which is provided with a solenoid control valve, a directional control valve actuated by said solenoid control valve and a relief valve.

5. An apparatus as claimed in claim 4, wherein one side of said circuit is connected to the pneumatic source and the other side of said circuit is connected to the accumulater.

6. An apparatus as claimed in claim 1, wherein said control means comprises switches corresponding to respective solenoid control valves and a switching device which selectively actuates said switches according to said press stroke signal at said predetermined timing.

* * * * *